United States Patent [19]

Whitehill

[11] 4,047,758

[45] Sept. 13, 1977

[54] ADJUSTABLE DENTAL RECLINER

[76] Inventor: Kenneth Jack Whitehill, 481 Forest Ave., Palo Alto, Calif. 94301

[21] Appl. No.: 660,228

[22] Filed: Feb. 23, 1976

[51] Int. Cl.[2] ..... A47C 3/00

[52] U.S. Cl. ..... 297/284; 297/71; 297/330; 297/410

[58] Field of Search ..... 297/330, DIG. 2, 410, 297/284, 391, 71, 68, 85, 91, 61, 316, 283, 324, 354

[56] References Cited

U.S. PATENT DOCUMENTS

| | | | |
|---|---|---|---|
| 3,027,195 | 3/1962 | Nelson et al. | 297/DIG. 2 |
| 3,156,500 | 11/1964 | Kerr | 297/DIG. 2 |
| 3,207,555 | 9/1965 | Kerr | 297/391 |
| 3,427,072 | 2/1969 | Hale | 297/330 X |
| 3,753,592 | 8/1973 | Jensen | 297/284 |
| 3,761,126 | 9/1973 | Mulholland | 297/391 X |
| 3,806,192 | 4/1974 | Ohlrogge | 297/330 X |
| 3,885,831 | 5/1975 | Rasmussen | 297/410 |
| 3,934,929 | 1/1976 | Rabinowitz | 297/330 |

*Primary Examiner*—James T. McCall
*Attorney, Agent, or Firm*—Phillips, Moore, Weissenberger, Lempio & Majestic

[57] ABSTRACT

A cushioned counter-balanced reclining dental chair has an underslung carriage which tilts with respect to a support to position a patient's heat at a desired work height. The angle of tilt is established by manual positioning which is facilitated by counter-balancing of the carriage, and is maintained at the desired tilt angle by a telescoping strut joined from the shoulder region of the recliner to the base. A shoulder support retains the patient's shoulders at a fixed distance from the tilt axis, independent of variations in height among patients. A buttocks engaging depression, which becomes more pronounced as the tilt of the carriage is increased to provide higher head positions, prevents the patient from sliding. The buttocks engaging depression's position is adjustable along the carriage to accomodate various body lengths, while at the same time maintaining the patient's shoulders in a shoulder cradle. A head support adjusts the position of the patient's head from upright to supine about an axis proximate the patient's shoulders. A patient is supported by the chair in a generally supine position which is comfortable to the patient and convenient for the dentist's access. No external power is required to operate the recliner.

30 Claims, 3 Drawing Figures

ADJUSTABLE DENTAL RECLINER

BACKGROUND OF THE INVENTION

This invention relates to a reclining dental examination and treatment chair, hereinafter called a dental recliner, and more particularly, to such a dental recliner which tilts to position the patient's head at the desired height.

In the past, dental recliners have utilized a fairly conventional chair having an articulated back and an articulated foot and leg support mechanism. A patient was required to sit on the seat portion which was, generally, adjustable in height. After the patient was seated, the articulated back was lowered, allowing the patient's head, shoulders and back to assume a supine position more or less on horizontal with the buttocks of the patient. The patient's legs were raised and supported in a comfortable position by the leg support mechanism. Dental examination and treatment then proceeded with adjustments being made in the location of the patient's head and body as required to accomodate the dentist's need for access, and to maintain a somewhat comfortable working position for the dentist. Since the back of the conventional dental chair has a fixed radius and pivots from a fixed radius point, only a small range of sizes of patients and could be accurately and comfortably supported.

If an unusually tall or unusually short person were to use the chair, the adjustments of the chair would be required to extend to their maximum or minimum limits, respectively, with the result that the patient would not be comfortably and accurately positioned. In some cases, the dentist would be required to assume an extremely uncomfortable and tiring working position because of the inability of the conventional chair to support the patient in the desired location.

As a consequence of the wide range of hip to head distances which the chair had to accomodate, the entire chair was required to be raised or lowered in order to position the patient's head at the required working level.

In the supine position, the back of the conventional chair was cantilevered from the seat and supported a large percentage of the patient's weight. To achieve necessary stability, the chair and the pivot mechanism had to be extremely rigid. The result of this requirement was that the structural elements of the chair were extremely massive. Because the weight of the chair and the patient were unmanageably heavy, a mechanically-assisted lifting mechanism was usually employed which increased the cost of manufacture and was slow to adjust to the desired working position. These two factors in combination caused the conventional dental chair to be inefficient in use of materials and expensive to manufacture.

A need, therefore, exists for a reclining dental chair which is economical to manufacture, easy to operate, and adjustable to the wide variety of human forms, sizes, and weights which it must accomodate.

SUMMARY OF THE PRESENT INVENTION

It is, therefore, an object of this invention to provide an apparatus for supporting a person in a supine or nearly supine position for dental examination and treatment.

It is another object of this invention to provide an apparatus for supporting a person for dental examination and treatment in which the position of a patient may be quickly and easily changed from supine to upright.

Still another object of this invention is to provide an apparatus for supporting a person for dental examination and treatment which is quickly adjustable to position the patient's head.

Yet still another object of this invention is to provide an apparatus for supporting a person for dental examination and treatment which is easily adjustable to accomodate various body lengths, including small children and tall adults.

Yet still another object of this invention is to provide an apparatus for supporting a person for dental examination and treatment which maintains an approximate balance for all sizes of occupants.

Still another object of this invention is to provide an apparatus for supporting a person for dental examination and treatment which yields to the patient's body shape for maximum comfort.

Yet still another object of this invention is to provide an apparatus for supporting a person for dental examination and treatment which has cushioning provision for uniform and comfortable body support.

Yet still another object of this invention is to provide an apparatus for supporting a person for dental examination and treatment which has head adjustment from upright to supine with correspondence between elevation of the patient's head and the angular position of the patient's head with respect to his body.

Yet still another object of this invention is to provide an apparatus for supporting a person for dental examination and treatment which is mechanically rigid.

Yet sill another object of this invention is to provide an apparatus for supporting a person for dental examination and treatment which does not require a vertical lift mechanism.

Yet still another object of this invention is to provide an apparatus for supporting a person for dental examination and treatment which can be manufactured at low cost.

Yet still another object of this invention is to provide an apparatus for supporting a person for dental examination and treatment which can be operated manually without excessive physical strain.

BRIEF DESCRIPTION OF THE DRAWINGS

These and other objects and advantages of the present dental recliner and the operation thereof will become apparent from the following detailed description and accompanying drawings in which.

DESCRIPTION OF THE PREFERRED EMBODIMENTS

General Description

Figure 1:
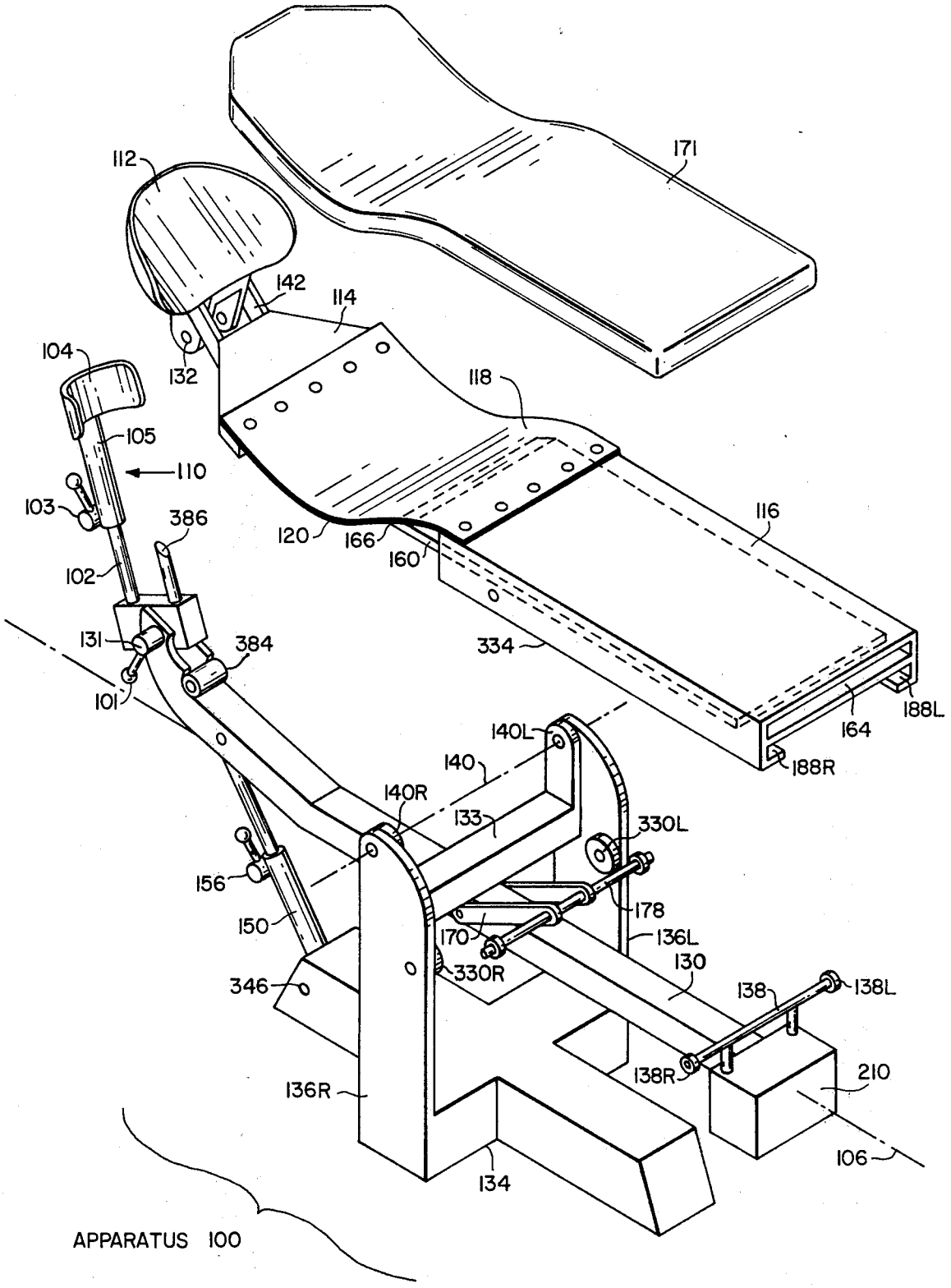
FIG. 1 is an exploded perspective drawing of the dental recliner 100.

Referring to FIG. 1 there is shown an apparatus 100 for supporting an occupant in a reclining position along longitudinal dimension 106. Head support assembly 110 tilts and rotates to support the occupant's head at the preferred angle. Shoulder support 112 cradles the occupant's shoulder region. Upper body support 114 is preferably rigid and supports the middle back region of the occupant. Lower body support 116 is also preferably rigid and supports the thighs and legs of the occupant. Middle body support 118 is preferably flexible and is suspended in hammock fashion between upper body support 114 and lower body support 116. The hip and abdomen weight of the occupant supported in recliner 100 causes flexible middle body support 118 to assume occupant's body profile forming a depression or pocket zone 120 which engages the seat bone of the occupant preventing the occupant from sliding downward in recliner 100 along longitudinal dimension 106.

Carriage 130 is a tiltable frame structure which retains the body, shoulder, and head supports and, in conjunction with articulating axes 178 and 138, radius arm 170, and roller supports 330R and 330L, adapts the body supports and shoulder supports to a patient's form. The carriage 130 is mounted by means of its U-shaped support bracket 133 to base assembly 134 formed by left and right vertical members 136L and 136R, and floor stabilizer 134.

Carriage 130 is attached to base assembly 134 by left and right pivots 140L and 140R at axis 140.

The head of the occupant may be positioned at the desired height by tilting carriage 130. At the desired tilt, reclining carriage 130 is retained in fixed relationship with base assembly 134 by telescoping strut 150 which is securely fastened at the desired length by clamping mechanism 156.

Depression 120 may be positioned anywhere within the flexible middle body support 118 to accomodate persons of differing heights and torso proportions by adjusting lower body support extender 160. Support extender 160 is preferably a rigid surface or planar member partially housed within slot 164 of lower body support 116. In order to accomodate children and smaller adults, the leading edge 166 of extending support 160 is extended into the region of middle body support 118 causing depression 120 to form closer to upper body support 114.

Cushion 171 may be placed over the body supports to provide padding against the rigid supports and against leading edge 166.

POSITIONING OF DEPRESSION

Figure 2:
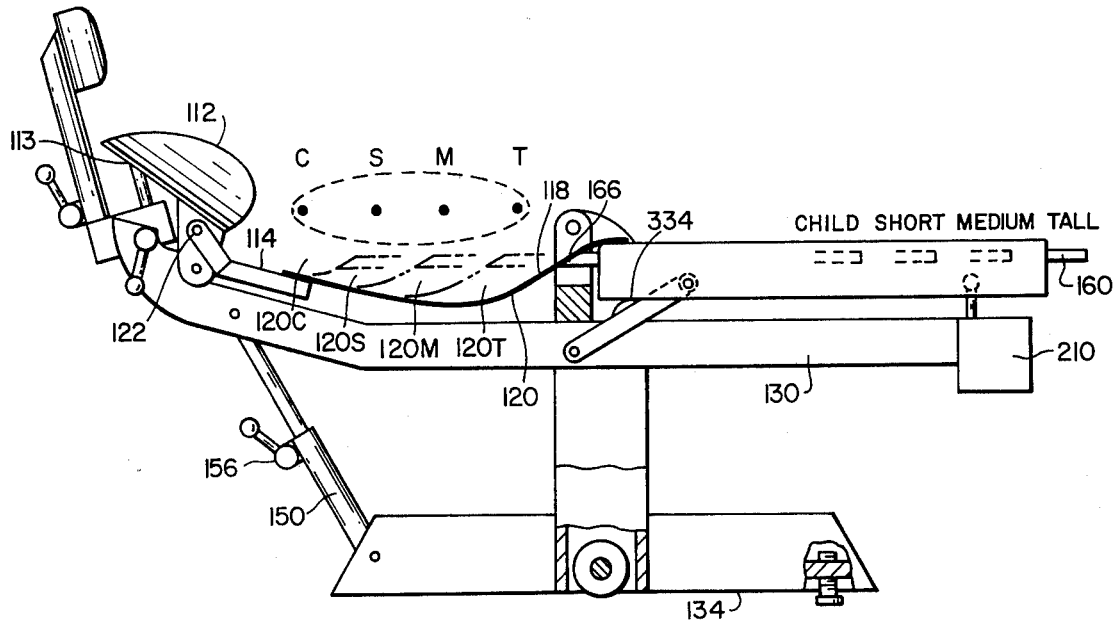
FIG. 2 is a sectional side view of the dental recliner of FIG. 1 illustrating the adjustment of the seat pocket to accomodate various lengths of bodies.

Referring now to FIG. 2, there is shown a partially sectional view of the dental recliner 100 of FIG. 1. The support extender 160 is shown, by means of phantom lines, in several positions designated "TALL," "MEDIUM," "SHORT" and "CHILD." These positions correspond approximately to, and serve to illustrate, the adjustments which would be made to accommodate dental patients having those heights.

In the TALL position, support extender 160 is least extended from the lower body support 116. The weight of a tall patient will cause the buttocks depression 120 to form near the leading edge 166 of the support extender 160, at position 120T.

Since the buttocks depression forms at the farthest possible position from the shoulder support 112, this position of the support extender 160 is suitable for patients having a long torso.

When it is desired to accommodate persons of smaller physical status, the support extender 160 is adjusted to extend farther from the lower body support 116. This causes the buttocks depression to form, under weight of a patient, at positions closer to the shoulder support 112. As depicted by the phantom lines in FIG. 2, the buttocks depression is formed at 120M for persons of medium height and at 120S for short persons, corresponding to positions MEDIUM, and SHORT for the support extender 160.

Figure 3:
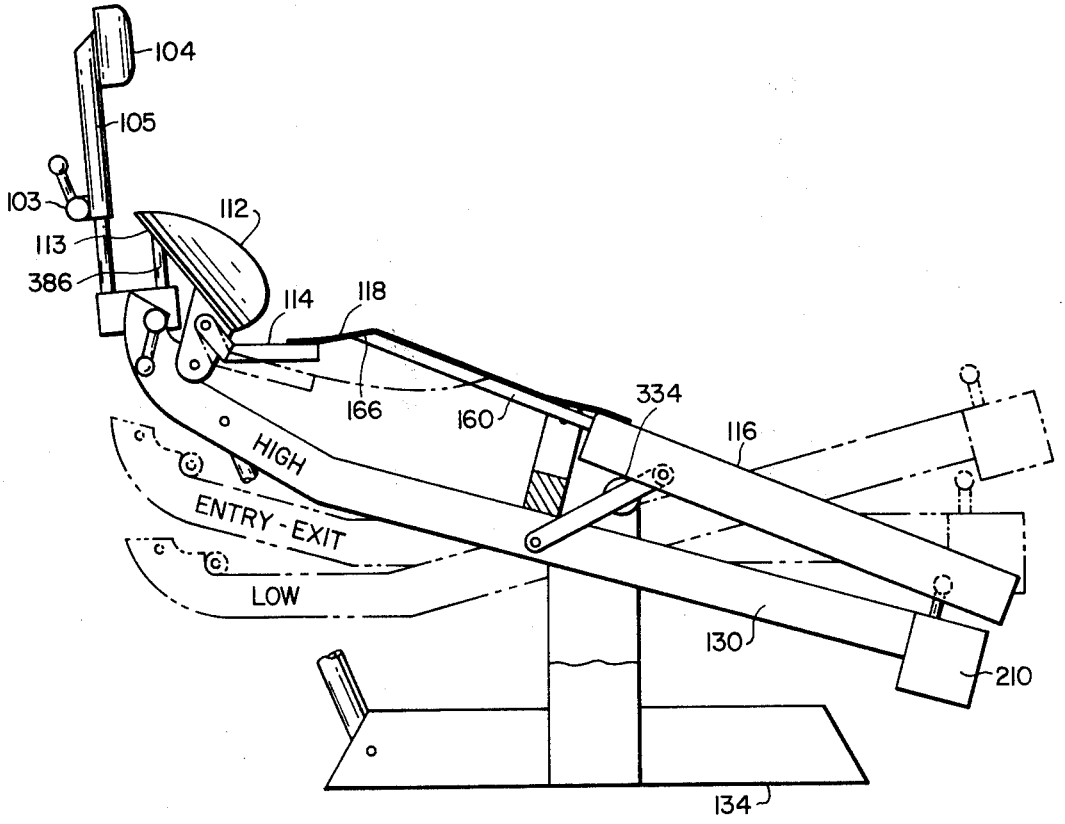
FIG. 3 is a sectional side view of the dental recliner of FIG. 1 illustrating how the recliner assumes differing angular positions with respect to its support in order to provide the optimum height for the patient's mouth and how the seat pocket becomes more pronounced as the recliner is tilted into steeper positions.

At its maximum extension, support extender 160 and upper body support 114 almost touch. The flexible webbing of middle body support 118 is almost completely supported by the rigid support extender 160 and rather than forming a depression as previously described, acts simply as a flexible connector for the support extender 160 and the upper body support member 114. When the carriage is maximally inclined, the rigid upper body support 114 is urged into a horizontal position by upward pressure on the flexible webbing of the middle body support 118, exerted by the leading edge of the support extender 160. In this position, the upper body support 114 serves as the seat for a small child while the shoulder support 112 serves as the child's back rest. This position is best illustrated in FIG. 3.

Since the position of support extender 160 is continuously adjustable from minimum to maximum extension, it may be seen that the position of the buttocks depression 120 with respect to the shoulder support 112 may be completely optimized for all adult sizes.

CARRIAGE BALANCE

Manual positioning of the carriage 130 is facilitated by two factors: 1) the center of gravity of the loaded carriage is near (preferably slightly below) the pivot axis 140, and; 2) the loaded carriage is in approximate static balance.

The first factor follows from the design of the carriage 130 and the carriage support bracket 133. At the level (entry-exit) position, the entire carriage 130 is below the pivot axis 140. Loading the carriage with a patient's weight raises the center of gravity somewhat but still maintains it close to the pivot axis 140.

The second factor is a feature of the recliner which depends upon the variation in distribution of body weight for persons of varying height.

This feature may be first illustrated by considering the care of a small child. The child's entire body is located to the left of the pivot axis 140. Thus a CCW turning moment is produced on the head end of the carriage. However, a CW turning moment, approximately equal to the CCW turning moment produced by the child's weight, is produced by the counterbalance weight 210.

The child's center of gravity is located at approximately point C in FIG. 2 at a position where it has nearly maximum effect upon the lever arm of the left portion of the carriage. By comparison, a tall adult's center of cavity, because of the more nearly uniform distribution of body weight over the entire length of the carriage 130, is located at approximately point T. Although the mass of the tall adult is much greater than that of the child, the center of gravity is located much closer to the pivot axis 140. Thus, the CCW turning moment produced by the tall adult approximates that produced by a child, thereby maintaining approximate static balance of the carriage.

Adults of medium and short stature generally have masses intermediate between those of the tall adult and a child and have centers of gravity located at distances intermediate to the locations for a tall adult and a child as shown by position "S" and "M" in FIG. 2. Again, the product of mass and center of gravity location produces a CCW turning moment which tends to equal to the CW turning moment produced by the inherent structure of the carriage 130. In addition, the mass of the support extender 160 assists in maintaining carriage balance by virtue of its adjustment for differing sizes of patients.

Tall, and consequently heavy, persons require the greatest amount of counterbalance weighting at the foot of the carriage, which corresponds to the adjustment of the support extender for maximum height persons. Short, and consequently light, persons require the least amount of counterbalance weighting at the foot of the carriage which corresponds to the positioning of the support extender to accommodate minimum height persons.

It is not intended that perfect balance be achieved for all patients; the variety of body sizes and mass distributions renders this goal unattainable. However, a sufficient approximation may be made to perfect balance to allow movement of the carriage to a desired tilt angle without undue strain and without requiring power assistance.

TILT POSITIONS AND ARTICULATION

The articulation of the supports and particularly that of the lower body support 116, around the carriage 130, may best be seen by reference to FIG. 3. In the figure, various positions of the recliner are shown with the carriage 130 depicted as assuming a HIGH position, an ENTRY-EXIT position, and a LOW position indicated by the dotted lines. The carriage 130 is supported by a U-shaped bracket 133, the arms of which are pivotally attached by right and left pivots 140R and 140L, to the left and right vertical members 136L and 136R of the base 134. By means of pivoting action, the carriage 130 can be swung through a considerable arc.

With the recliner 100 in the ENTRY-EXIT position indicated by the phantom lines, a patient enters the recliner by sitting in the depression 120 then swinging his legs onto the lower body support 116 and reclining onto the upper body support 114 and shoulder support 112. The support extender 160 is adjusted to provide the proper location for the buttocks engaging depression 120.

With the patient resting in the ENTRY-EXIT position, the carriage position lock 156 may be loosened and the carriage tilted to the desired position. A LOW position with the patient's head slightly below the ENTRY-EXIT position is useful to a dentist working in a sitting position. The extreme low position may be used in emergencies for fainting or shock treatment with the patient's head being located substantially below his feet. The HIGH position, useful for a child or for a standing dentist working on an adult is established by tilting carriage 130 to a forward position. For adults, support extender 160 may be unextended or partially extended to position the buttocks engaging depression 120 according to the adult's height. For children, the support extender 160 will generally be extended to its maximum causing the upper body support 114 to be tilted slightly backward beyond the horizontal forming a backward sloping platform on which to seat a child.

The movement of the lower body support as the recliner is tilted through successively steeper angles may be understood by examining the movement of the carriage from LOW position to HIGH position.

With the carriage in LOW position, the lower body support 116 rests entirely on pivot axis 178, and pivot axis 138 which in turn rests in the lower set of channels 188L and 188R under the lower body support 116. As the carriage 130 is moved through successively steeper angles toward the HIGH position, the bottom surface 334 of the lower body support 116 engages rollers 330L and 330R affixed to each side 136R and 136L of the base 134. Upon engagement, the lower body support is supported by the rollers 330R and 330L and by the base support roller 138R and 138L at axis 138. While axis 178 continues to engage the lower body support 116, most of the weight of the lower body support is carried by axes 330 and 138. As the carriage 130 continues movement toward the vertical, rollers 330R and 330L urge the lower body support 116 away from the carriage. Since radius arm 170 attached to both the carriage and axis 178, movement of axis 178 with respect to the carriage 130 is possible only in an arc. As a result, the lower body support 116 moves toward the head of the carriage as well as away from the carriage. Upward travel is allowed by the arrangement of axis 138 which is free to move longitudinally with respect to the lower body support 116 within channels 188L and 188R.

The upward and headward movement of the lower body support with respect to the carriage 130 is transmitted to the middle body support 118 by the leading edge 166 of the support extender 160.

This headward and upward movement causes a deepening of the buttocks engaging depression 120, thereby engaging more of the patient's body to prevent sliding as the angle of inclination becomes steeper. As the extender is farther and farther extended to accommodate shorter persons, the radius of the arc it describes about pivot 178 is increased. The movement of the leading edge 166 away from the carriage is therefore also increased. This is particularly advantageous for the effect which it produces on the upper body support 114. To accommodate small persons, the upper body support 114 is employed as a seat, with the shoulder support 112 serving as a backrest. When fully extended, the headward movement of the leading edge 166 of the support extender 160 facilitates this use by providing a slight backward incline in the upper body support 114 by which a small person is securely retained on the recliner.

The maximum upward movement of the lower body support 116 is established by bottoming of rollers 138R and 138L within the channels 188L and 188R. At the other extreme, downward movement of the carriage 130 is limited by the fully closed length of telescoping support member 150 which also locks and maintains the carriage 130 at the desired angle of tilt through means of locking mechanism 156.

HEAD AND SHOULDER SUPPORT

Shoulder support 112 is contoured to generally conform to the shapes of the shoulders and upper back of the patient. The sides of the shoulder support preferably curve upwards and extend toward middle body support 118 in order to retain the patient's upper arm region and to urge the patient's arms and hands into the patient's lap or along the patient's body, out of the way of the attending dentist.

Cradle 112 is preferably formed of a thin sheet, of a strong material such as stainless steel, in order to allow the dentist to work as close as possible to the patient. It is particularly important to afford the dentist maximum knee space when working in a sitting position so that a less extended and consequently steadier and more comfortable position may be assumed.

Shoulder support 112 pivots around axis 384 within limits established by stops on the carriage 130 and striker arm 386 on headrest bracket 102. The striker arm 386 is adapted to strike the back surface 113 of shoulder support 112 at a point intermediate to the pivot axis 384 and the top of the shoulder support 112. When the headrest support bracket 102 is inclined to its maximum extent, the striker allows a corresponding movement of the shoulder support 112. However, due to the difference in pivot locations for the headrest support bracket 102 and the shoulder support 112, the shoulder support 112 may pivot through an angle only approximately one-half as great as that of the headrest support bracket 102.

This produces a limitation on the minimum angle which can be produced between the headrest 104 and shoulder support 112 thereby eliminating severe discontinuities in the support provided a patient's head, shoulders, and upper body.

As shoulder support 112 reclines under the weight of a patient's shoulders, axis 122 moves toward the head of the carriage 130. Bracket 142, attached to pivot point 122 and upper body support 114, applies tension to the flexible middle body support 118. This causes the buttocks engaging depression 120 to rise somewhat. Because of the offset angle in bracket 142, upper body support 114 tends to tilt upwards when tension is applied to the middle body support 114. Thus, as the headrest support bracket 102 reclines, the shoulder support 112 reclines by a slightly smaller amount and the upper body support 114 reclines around axis 122 by a still smaller amount. The progressive uncurling of the supports allows the patient's body to gradually assume a supine position as the supports recline. The amount of uncurling may be established at any convenient position by locking the headrest support bracket into position by means of clamping mechanism 101.

Tension and weight on the middle body support 114 produce a force which counterbalances the force produced by the weight of a patient's shoulder acting at pivot axis 122. An equilibrium results which provides optimum support of the patient's shoulders and upper back, and middle body without excessive pressure being produced at any point.

The patient's head is supported in the desired relationship to the carriage 130 by means of a head support assembly 110 consisting of headrest bracket 102, headrest column 105, and headrest 104. Positioning of the headrest bracket 102 is accomplished by manually rotating the bracket around pivot axis 131 as described above. The headrest may be adjusted to a convenient distance from the pivot axis 131 by sliding the headrest column 105 along the headrest bracket 102. Rotation of the headrest with respect to the bracket 102 allows turning of the patient's head for convenient access to the mouth.

When the headrest has been positioned at the desired location, it is secured by locking mechanisms 101 and 103. The location of the headrest pivot 131 at the extreme end of the carriage 130 allows an extremely large angular movement, even to the extent, if desired, that a patient's head may be positioned to look upward and backward.

Other variations of the invention may be practiced, as is evident from consideration of the general operating principles without departure being made from the spirit of the invention.

What is claimed is:

1. An apparatus for supporting an occupant in a generally reclining position, comprising:

a generally elongated carriage having a head end and a foot end;

a shoulder support mounted to pivot about a first horizontal axis disposed above said carriage and generally perpendicular to the longitudinal dimension thereof near the head end thereof for supporting at least the occupant's shoulders;

an upper body support mounted to said shoulder support to pivot about a second horizontal axis parallel to and generally above said first horizontal axis for supporting at least the occupant's upper body the relative relationship of said first and second axes allowing an occupant to readily sit up from a supine position;

a headrest assembly lockably pivotally mounted to the head end of the carriage for supporting the occupant's head;

a lower body support mounted to the foot end of the carriage for supporting at least the occupant's legs;

a middle body support positioned between the upper body support and the lower body support for supporting the middle body of the occupant, said middle body support accommodating the contour of the lower back region and hip region of the occupant, and base means for supporting the carriage.

2. An apparatus as in claim 1, including means for altering the longitudinal dimension of the middle body support for accommodating occupants of differing body lengths.

3. The apparatus of claim 2, wherein the middle body support is flexible and is urged into contact with the lower back region and hip region of the occupant by the weight of the occupant.

4. The apparatus of claim 3, wherein the middle body support is suspended in hammock fashion between the upper body support and the lower support.

5. The apparatus of claim 4, wherein the means for altering the longitudinal dimension of the middle body support foreshortens the middle body support.

6. The apparatus of claim 5, wherein the flexible middle body support is foreshortened by selectively firming the middle body support.

7. The apparatus of claim 5, wherein the means for progressively foreshortening the middle body support extends from the lower body support.

8. The apparatus of claim 5, wherein the means for foreshortening the middle body support is a rigid structure extending into the region of the middle body support from the direction of the lower body support.

9. The apparatus of claim 3, wherein the lower body support is extendable toward the middle body support, and the means for altering the longitudinal dimension of the middle body support is a movable rigid surface portion of the lower body support which is movable into the region of the middle body support.

10. The apparatus of claim 9, wherein the leading edge of the rigid surface portion defines the interface between the foreshortenable middle body support and the extendable lower body support.

11. The apparatus of claim 10 wherein the leading edge of the rigid surface portions defines a break edge between the contoured profile of the flexible middle body support and rigid lower body support.

12. The apparatus of claim 11, wherein the base means is a stand for supporting the carriage, and the carriage and supports supported thereon are tiltable with respect to the stand.

13. The apparatus of claim 12, wherein the carriage is tiltably mounted with respect to the stand about a generally horizontal axis of tilt which is generally perpendicular to the longitudinal dimension of the apparatus and located between the upper body support and the lower body support.

14. The apparatus of claim 13, wherein the breaking edge of the rigid surface is moved relative to the carriage and support members as the carriage is tilted.

15. The apparatus of claim 14, wherein the breaking edge is tilted upward and headward with respect to the carriage as the carriage is tilted toward vertical to raise the occupant's head.

16. The apparatus of claim 15 wherein the stand has rollers mounted on each side and the lower body support's upward and headward movement is produced by the lower body support engaging the rollers as the carriage is tilted relative to the stand.

17. The apparatus of claim 13, wherein the longitudinal dimension of the middle body support is altered by moving the movable rigid surface portion toward the upper body support for accomodating shorter occupants and toward the lower body support to accomodate taller occupants.

18. The apparatus of claim 17, wherein the center of gravity, weight, and turning arm of the carriage and the body supports and the occupant have a combined turning moment which is generally balanced about the tilt axis, and, as the longitudinal dimension of the middle body support is altered to accomodate shorter occupants of generally lower weight, the center of gravity of the occupant is displaced toward the upper body support increasing the turning arm of the occupant compensating at least in part for the generally lower weight.

19. The apparatus of claim 18, wherein the weight of the movable rigid portion is shifted toward the upper body support as the apparatus is adjusted to accomodate shorter occupants, causing a change in the turning moment of the movable rigid portion about the tilt axis which at least in part compensates for the generally lower weight of the shorter occupant.

20. The apparatus of claim 1, wherein the shoulder support is a shoulder cradle laterally contoured to approximate the shape of the occupant's shoulders.

21. The apparatus of claim 20, wherein the lateral regions of the shoulder cradle extend toward the lower body support to retain at least the upper arm regions.

22. The apparatus of claim 20, wherein the shoulder cradle is formed of a thin rigid material.

23. The apparatus of claim 3, further comprising a connecting bracket between the shoulder cradle and the flexible middle support for causing the middle support to lift as the shoulder cradle tilts backward.

24. The apparatus of claim 13, wherein an adjustable support strut extends from the head end of the carriage to the base means for locking the carriage in position.

25. The apparatus of claim 24, wherein the base means further comprises a horizontal stabilizer extending at least longitudinally along the bottom of the base, and the adjustable support strut means engages one end thereof.

26. The apparatus of claim 1, wherein a headrest is mounted to the headrest assembly on a telescoping column.

27. The apparatus of claim 26, wherein the headrest is rotatable around the axis of the column.

28. The apparatus of claim 26, wherein the headrest assembly slidably engages a portion of the shoulder support through a part of the rotational adjustment of the headrest assembly for simultaneously regulating the recline of the headrest assembly, the shoulder support and the upper body support and changing the acuteness of the angle between the headrest and the shoulder support.

29. An apparatus as in claim 28, including stop means on said carriage contacting the shoulder support on rotation thereof to limit an angle through which said shoulder support can be rotated whereby said headrest can be rotated so that said headrest assembly moves out of engagement with said portion of said shoulder support and said headrest thereby rotates further towards a floor than does said shoulder support to allow an occupant's head to be supportedly tilted backwardly from a supine position.

30. An apparatus as in claim 28, wherein said headrest assembly includes a striker arm which strikes a back surface of said shoulder support to provide said slidable engagement of said headrest assembly with said shoulder support.

* * * * *